US010916838B2

(12) United States Patent
Chiu et al.

(10) Patent No.: US 10,916,838 B2
(45) Date of Patent: Feb. 9, 2021

(54) ELECTRONIC MODULE

(71) Applicant: Siliconware Precision Industries Co., Ltd., Taichung (TW)

(72) Inventors: Chih-Hsien Chiu, Taichung (TW); Chi-Liang Shih, Taichung (TW)

(73) Assignee: Siliconware Precision Industries Co., Ltd., Taichung (TW)

( * ) Notice: Subject to any disclaimer, the term of this patent is extended or adjusted under 35 U.S.C. 154(b) by 319 days.

(21) Appl. No.: 14/695,469

(22) Filed: Apr. 24, 2015

(65) Prior Publication Data

US 2016/0172762 A1 Jun. 16, 2016

(30) Foreign Application Priority Data

Dec. 10, 2014 (TW) ..... 103142971 A

(51) Int. Cl.

| | |
|---|---|
| ***H01Q 9/04*** | (2006.01) |
| ***H01Q 1/38*** | (2006.01) |
| ***H01Q 1/40*** | (2006.01) |
| ***H01Q 9/42*** | (2006.01) |
| *H01Q 1/22* | (2006.01) |

(52) U.S. Cl.

CPC ..... *H01Q 1/38* (2013.01); *H01Q 1/40* (2013.01); *H01Q 9/42* (2013.01); *H01Q 1/22* (2013.01)

(58) Field of Classification Search

CPC .. H01Q 1/38; H01Q 1/22; H01Q 1/40; H01Q 9/42; H01Q 9/0414

See application file for complete search history.

(56) References Cited

U.S. PATENT DOCUMENTS

| | | | | |
|---|---|---|---|---|
| 7,369,086 | B2 * | 5/2008 | Luen | H01Q 9/0414 343/700 MS |
| 7,408,512 | B1 * | 8/2008 | Rodenbeck | H01Q 1/2208 343/700 MS |
| 2008/0158069 | A1 * | 7/2008 | Mateus Mendes | H01Q 1/38 343/700 MS |
| 2010/0252637 | A1 * | 10/2010 | Bouchard | G06K 19/07718 235/488 |
| 2015/0380848 | A1 * | 12/2015 | Kato | H01R 12/78 439/67 |
| 2018/0159209 | A1 * | 6/2018 | Mikata | H01Q 1/38 |

* cited by examiner

*Primary Examiner* — Graham P Smith
*Assistant Examiner* — Jae K Kim
(74) *Attorney, Agent, or Firm* — Mintz Levin Cohn Ferris Glovsky and Popeo, P.C.; Peter F. Corless; Steven M. Jensen

(57) ABSTRACT

An electronic module is provided, which includes: a substrate; an antenna body disposed over the substrate; and an encapsulant formed on the substrate and encapsulating the antenna body. A portion of the antenna body is exposed from the encapsulant. As such, the invention increases the arrangement area of the antenna body without increasing the size of the substrate, and also reduces the height of the encapsulant. Therefore, the electronic module of the present invention meets the miniaturization requirement.

11 Claims, 10 Drawing Sheets

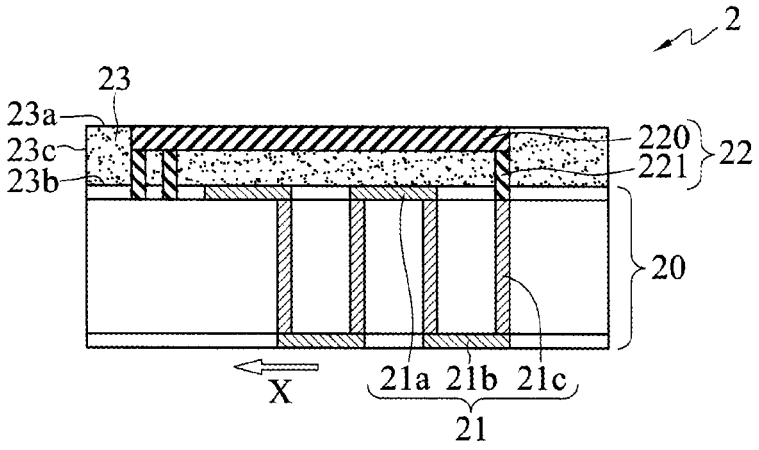
FIG. 2
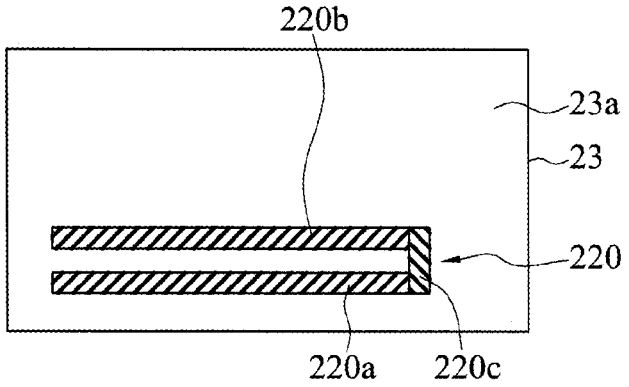
FIG. 2'
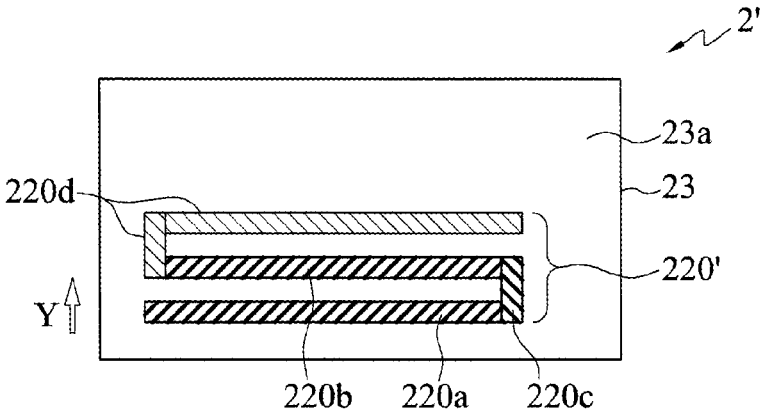
FIG. 2"

ELECTRONIC MODULE

CROSS-REFERENCES TO RELATED APPLICATIONS

This application claims under 35 U.S.C. § 119(a) the benefit of Taiwanese Application No. 103142971, filed Dec. 10, 2014, the entire contents of which are incorporated herein by reference.

BACKGROUND OF THE INVENTION

1. Field of the Invention

The present invention relates to electronic modules, and more particularly, to an electronic module having an antenna.

2. Description of Related Art

Along with the rapid development of electronic industries, electronic products are developed toward the trend of multi-function and high performance. Wireless communication technologies have been widely applied in various kinds of consumer electronic products for receiving or transmitting various wireless signals. To meet the miniaturization requirement of consumer electronic products, wireless communication modules are becoming lighter, thinner, shorter and smaller. For example, patch antennas have been widely applied in wireless communication modules of electronic products such as cell phones and personal digital assistants (PDAs) due to their advantages of small size, light weight and easy fabrication.

FIG. 1 is a schematic perspective view of a conventional wireless communication module. Referring to FIG. 1, the wireless communication module 1 has: a substrate 10, a plurality of electronic elements 11 disposed on and electrically connected to the substrate 10, an antenna structure 12 disposed on the substrate 10, and an encapsulant 13. The substrate 10 is a circuit board and has a rectangular shape. The antenna structure 12 is of a planar type. The antenna structure 12 has an antenna main body 120 and a conductive wire 121 electrically connecting the antenna main body 120 to the electronic elements 11. The encapsulant 13 encapsulates the electronic elements 11 and a portion of the conductive wire 121.

However, during the fabrication process of the wireless communication module 1, based on the characteristic of electromagnetic radiation between the planar-type antenna structure 12 and the electronic elements 11 and limitation of the size of the planar-type antenna structure 12, the antenna main body 120 of the antenna structure 12 cannot be integrally fabricated with the electronic elements 11. That is, only the electronic elements 11 are covered by the encapsulant 13, and the antenna main body 120 of the antenna structure 12 is exposed from the encapsulant 13. Therefore, the molding process for forming the encapsulant 13 needs to use a mold having a size corresponding to the electronic element-mounting area instead of the overall substrate 10, thus complicating the molding process.

Further, since the surface of the substrate 10 needs an additional area for disposing the antenna main body 120 (i.e, an area where the encapsulant 13 is not to be formed), the size of the substrate 10 and thus the size of the wireless communication module 1 are increased. As such, the wireless communication module 1 cannot meet the miniaturization requirement.

Therefore, how to overcome the above-described drawbacks has become critical.

SUMMARY OF THE INVENTION

In view of the above-described drawbacks, the present invention provides an electronic module, which comprises: a substrate; an antenna body disposed over the substrate; and an encapsulant formed on the substrate and encapsulating the antenna body, wherein a portion of the antenna body is exposed from the encapsulant, and the encapsulant has a first surface, a second surface opposite to the first surface and bonded to the substrate, and a side surface adjacent to and connecting the first and second surfaces.

In an embodiment, the substrate has at least an antenna structure, and the antenna body is electrically connected to the antenna structure.

In an embodiment, the antenna body is exposed from the first surface of the encapsulant.

In an embodiment, the antenna body is exposed from the side surface of the encapsulant.

In an embodiment, the antenna body is exposed from the first surface and the side surface of the encapsulant.

In an embodiment, the antenna body has an external connecting portion and at least a supporting portion connected to the external connecting portion, the external connecting portion being supported over the substrate by the supporting portion. Further, the external connecting portion can have a bent shape. In an embodiment, the external connecting portion is disposed on the first surface of the encapsulant and has an extending segment. In an embodiment, the external connecting portion has an extending segment extending along the side surface of the encapsulant to the first surface of the encapsulant. In an embodiment, the external connecting portion has an extending segment extending around the side surface of the encapsulant.

In an embodiment, the first surface of the encapsulant has at least an opening exposing the antenna body. Further, the antenna body can have an extending segment extending along the opening to the first surface of the encapsulant.

Therefore, since the antenna body is exposed from the encapsulant, the present invention increases the arrangement area of the antenna body without increasing the size of the substrate, and also reduces the height of the encapsulant. Compared with the prior art, the electronic module of the present invention meets the miniaturization requirement.

BRIEF DESCRIPTION OF DRAWINGS

FIGS. 2 and 2' are schematic cross-sectional and upper views of an electronic module according to a first embodiment of the present invention;

FIG. 2" is a schematic upper view of an electronic module according to a second embodiment of the present invention;

DETAILED DESCRIPTION OF PREFERRED EMBODIMENTS

Figure 1:
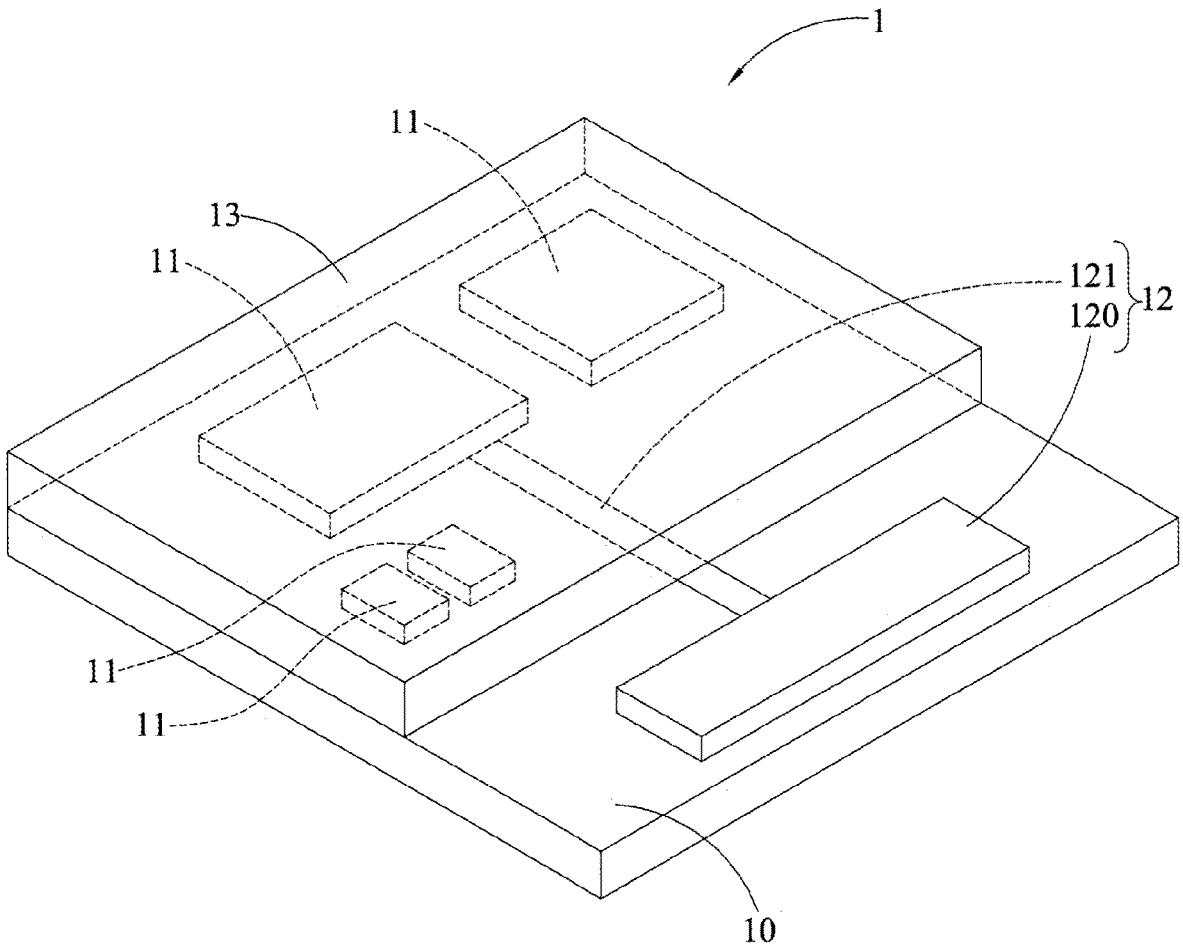
FIG. 1 (PRIOR ART)
FIG. 1 is a schematic perspective view of a conventional wireless communication module.

The following illustrative embodiments are provided to illustrate the disclosure of the present invention, these and other advantages and effects can be apparent to those in the art after reading this specification.

It should be noted that all the drawings are not intended to limit the present invention. Various modifications and variations can be made without departing from the spirit of the present invention. Further, terms such as "first", "second", "on", "a" etc. are merely for illustrative purposes and should not be construed to limit the scope of the present invention.

FIGS. 2 and 2' are schematic cross-sectional and upper views of an electronic module 2 according to a first embodiment of the present invention.

Referring to FIG. 2, the electronic module 2 is a SiP (system in package) wireless communication module. The electronic module 2 has: a substrate 20 having at least an antenna structure 21; an antenna body 22 disposed over the substrate 20 and the antenna structure 21; and an encapsulant 23 formed on the substrate 20 and encapsulating the antenna body 22.

The substrate 20 is a circuit board or a ceramic board and has circuits (not shown) formed thereon. In the present embodiment, a plurality of electronic elements (not shown) are disposed on the substrate 20. Each of the electronic elements is an active element such as a semiconductor chip, a passive element such as a resistor, a capacitor or an inductor, or a combination thereof. The electronic elements are electrically connected to the circuits of the substrate 20.

The antenna structure 21 is made of a metal material. The antenna structure 21 has a plurality of first extending portions 21*a* and a plurality of second extending portions 21*b* disposed on two opposite sides of the substrate 20, and a plurality of connecting portions 21*c* disposed in the substrate 20 for electrically connecting the first and second extending portions 21*a*, 21*b*. Further, every two adjacent connecting portions 21*c* are connected through one of the first extending portions 21*a* and the second extending portions 21*b*. The first extending portions 21*a* and the second extending portions 21*b* are not aligned in position. For example, the first extending portions 21*a* and the second extending portions 21*b* are arranged in an alternate manner.

In the present embodiment, the first extending portions 21*a* and the second extending portions 21*b* are arranged in an alternate manner according to the requirement, and the antenna structure 21 extends in a zigzag manner in the width direction of the substrate 20, for example, in an arrow direction X of FIG. 2.

Further, the connecting portions 21*c* are metal vias that penetrate the substrate 20. In the present embodiment, the connecting portions 21*c* are not exposed from the side surface of the substrate 20. In another embodiment, the connecting portions 21*c* are exposed from the side surface of the substrate 20.

Therefore, the antenna structure 21 has a 3D structure. The first and second extending portions 21*a*, 21*b* are disposed on the two opposite sides of the substrate 20 and the connecting portions 21*c* are disposed in the substrate 20. As such, the area of the substrate 20 for disposing the antenna structure 21 corresponds to the area of the substrate 20 for forming the encapsulant 23. Therefore, the present invention can use a mold having a size corresponding to the substrate 20 so as to facilitate the molding process for forming the encapsulant 23.

Further, since the 3D antenna structure 21 is disposed in an area of the substrate 20 where the encapsulant 23 is to be formed, the present invention does not need to provide an additional area on the surface of the substrate 20 for disposing the antenna structure as in the prior art. As such, the present invention reduces the size of the substrate 20 and thus the size of the electronic module 2. Therefore, the electronic module 2 of the present invention meets the miniaturization requirement.

The antenna body 22 has an external connecting portion 220 and a plurality of supporting portions 221 connected to the external connecting portion 220. The external connecting portion 220 is supported over the substrate 20 (or the first extending portions 21*a* of the antenna structure 21) by the supporting portions 221. As such, the external connecting portion 220 is located at a position higher than the electronic elements, and correspondingly extends along side edges of the substrate 20 to enclose the electronic elements.

In the present embodiment, the external connecting portion 220 serves as an antenna main body and has a first antenna segment 220*a*, a second antenna segment 220*b* and a connecting segment 220*c* connecting the first antenna segment 220*a* and the second antenna segment 220*b*. As such, the external connecting portion 220 has a bent shape, for example, an L-shape, a ring shape, or a ring shape having an opening. Referring to FIG. 2', the external connecting portion 220, for example, has a substantially n-shape.

The antenna body 22 is a metal frame, and at least a supporting portion 221 is provided. The supporting portions 221 are in contact with the connecting portions 21*c* and thus the external connecting portion 220 is electrically connected to the connecting portions 21*c* through the supporting portions 221. In another embodiment, the supporting portions 221 are in contact with the first extending portions 21*a* so as to electrically connect the external connecting portion 220 to the antenna structure 21. In a further embodiment, the external connecting portion 220 and the connecting portions 21*c* (or the first extending portions 21*a*) are electrically connected through bonding wires. In still another embodiment, the external connecting portion 220 and the connecting portions 21*c* (or the first extending portions 21*a*) are electrically connected through conductors such as solder balls or copper pillars.

The encapsulant 23 encapsulates the electronic elements, the first extending portions 21*a*, the external connecting portion 220 and the supporting portions 221.

In the present embodiment, the encapsulant 23 has a first surface 23*a*, a second surface 23*b* opposite to the first surface 23*a* and bonded to the substrate 20, and a side surface 23*c* adjacent to and connecting the first and second surfaces 23*a*, 23*b*. The external connecting portion 220 is exposed from the first surface 23*a* of the encapsulant 23.

The encapsulant 23 can be used to fix the antenna body 22. The external connecting portion 220 is fixed at a certain height by the encapsulant 23 so as to ensure the stability of the antenna. Further, the dielectric constant of the encapsulant 23 facilitates to reduce the required electrical length of the antenna.

FIG. 2" shows an electronic module 2' according to a second embodiment of the present invention. Referring to FIG. 2", the external connecting portion 220' has an extending segment 220*d* formed on the first surface 23*a* of the encapsulant 23 by coating or plating. The extending segment 220*d* has a bent shape, for example, an L-shape of FIG. 2", a ring shape, or a ring shape having an opening. As such, the external connecting portion 220' extends on the first surface 23*a* of the encapsulant 23 in a zigzag manner in, for example, an arrow direction Y.

In the electronic module 2, 2', the external connecting portion 220 is exposed from the first surface 23*a* of the encapsulant 23 so as to reduce the height of the encapsulant 23. Therefore, compared with the conventional planar-type antenna structure, the electronic module 2, 2' of the present invention meets the miniaturization requirement.

Further, the present invention replaces the conventional planar-type antenna structure with the 3D antenna body 22 that is formed by bending a metal sheet. The antenna body 22 is disposed over the substrate 20 with the external connecting portion 220, 220' enclosing the electronic elements. As such, the external connecting portion 220, 220' can be integrally fabricated with the electronic elements. That is, both the electronic elements and the external connecting portion 220, 220' can be encapsulated by the encapsulant 23. Therefore, the present invention can use a mold having a size corresponding to the substrate 20 so as to facilitate the molding process.

Furthermore, the external connecting portion 220, 220' is disposed over the substrate 20 and hence the antenna body 22 has a 3D structure. As such, the antenna body 22 can be disposed in the same area as the electronic elements (i.e., where the encapsulant 23 is to be formed). Therefore, the present invention eliminates the need to provide an additional area on the substrate 20 for disposing the antenna body. Compared with the planar-type antenna structure, the present invention reduces the size of the substrate 20 and thus the size of the electronic module 2, 2'. Therefore, the electronic module 2, 2' meets the miniaturization requirement.

In addition, since the external connecting portion 220, 220' is disposed over the substrate 20, a receiving space is formed between the external connecting portion 220, 220' and the substrate 20. The receiving space can be used to receive other electrical structures.

Figure 3A:
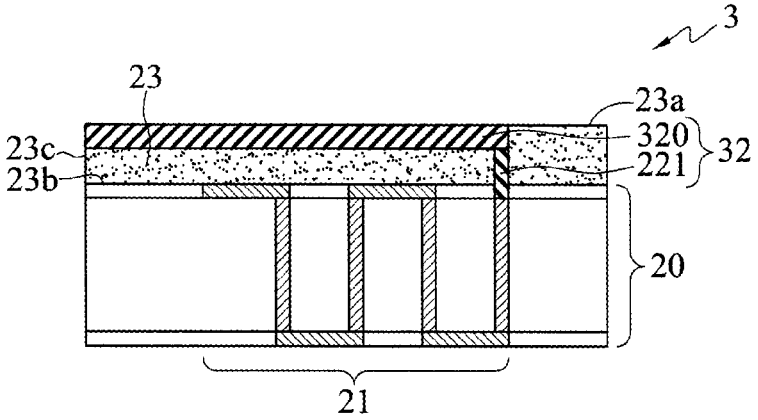
FIGS. 3A and 3B are schematic cross-sectional views of an electronic module according to a third embodiment of the present invention, wherein FIGS. 3A' and 3B' are schematic upper views of FIGS. 3A and 3B, respectively.
Figure 3A:
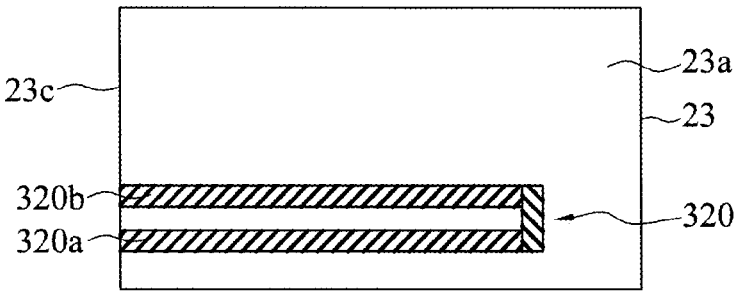
Figure 3B:
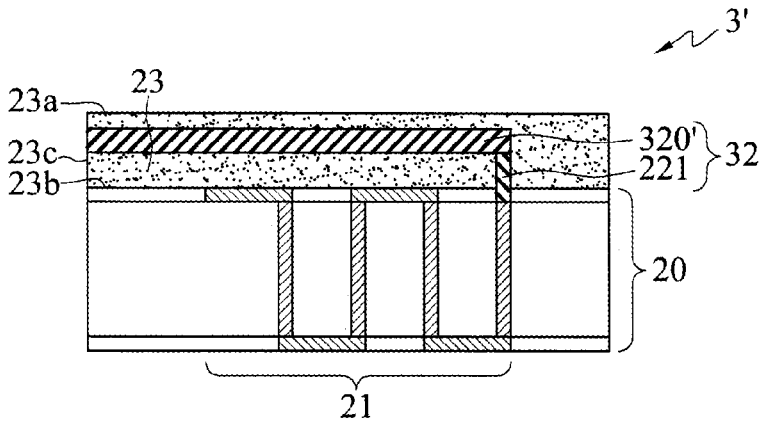
Figure 3B:
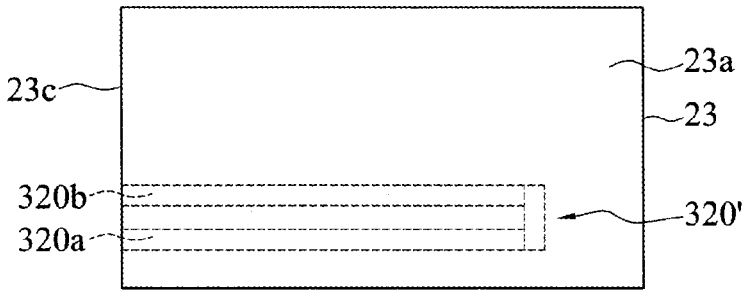

FIGS. 3A and 3B are schematic cross-sectional views of an electronic module 3, 3' according to a third embodiment of the present invention. The present embodiment differs from the first and second embodiments in the arrangement of the antenna body.

Referring to FIGS. 3A and 3A', both the first antenna segment 320*a* and the second antenna segment 320*b* of the external connecting portion 320 of the antenna body 32 are exposed from the side surface 23*c* of the encapsulant 23, and the external connecting portion 320 of the antenna body 32 is also exposed from the first surface 23*a* of the encapsulant 23.

Alternatively, referring to FIGS. 3B and 3B', the first antenna segment 320*a* and the second antenna segment 320*b* of the external connecting portion 320' of the antenna body 32 are exposed from the side surface 23*c* of the encapsulant 23. But the external connecting portion 320 of the antenna body 32 is not exposed from the first surface 23*a* of the encapsulant 23.

In the electronic module 3, 3', the external connecting portion 320, 320' is exposed from the first surface 23*a* and/or the side surface 23*c* of the encapsulant 23 so as to reduce the height of the encapsulant 23. As such, the electronic module 3, 3' meets the miniaturization requirement.

Figure 4A:
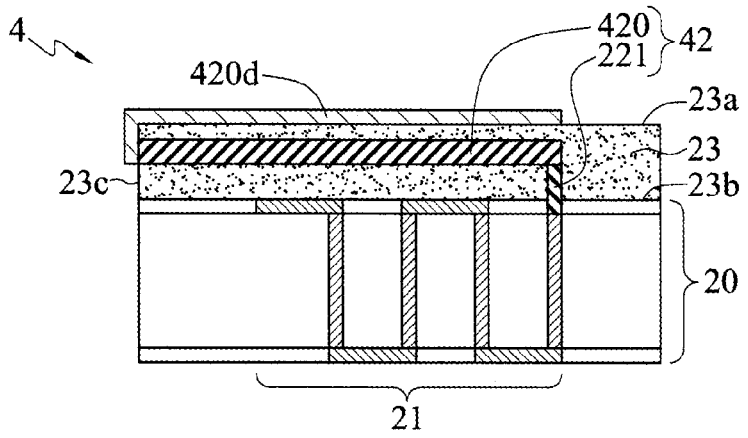
FIGS. 4A and 4B are schematic cross-sectional views of an electronic module according to a fourth embodiment of the present invention, wherein FIGS. 4A' and 4B' are schematic upper views of FIGS. 4A and 4B, respectively.
Figure 4A:
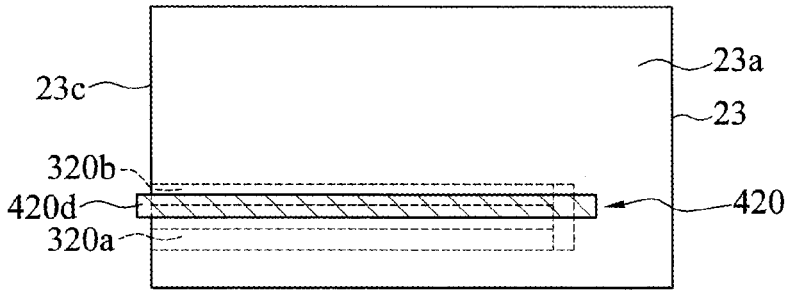
Figure 4B:
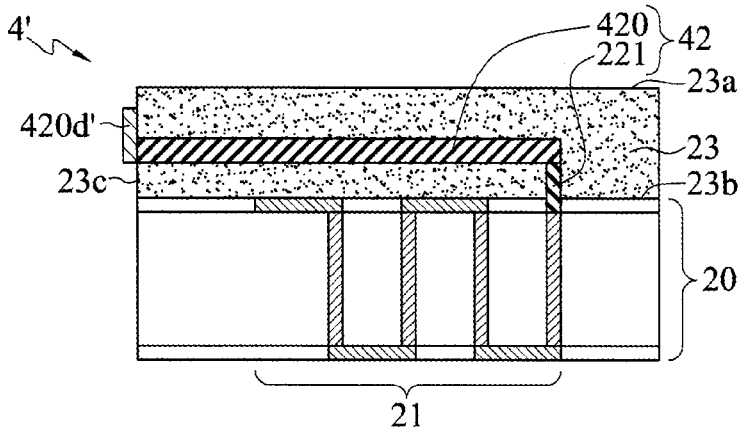
Figure 4B:
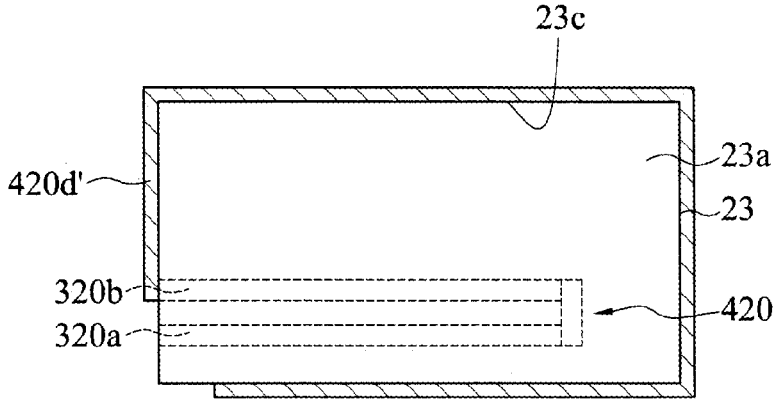

FIGS. 4A and 4B are schematic cross-sectional views of an electronic module 4, 4' according to a fourth embodiment of the present invention. The present embodiment differs from the third embodiment of FIG. 3B in the arrangement of the antenna body.

Referring to FIGS. 4A and 4A', an extending segment 420*d* is further formed on an exposed surface of the second antenna segment 320*b* of the external connecting portion 420 of the antenna body 42 by coating or plating. The extending segment 420*d* extends along the side surface 23*c* of the encapsulant 23 to the first surface 23*a* of the encapsulant 23. As such, the extending segment 420*d* has a bent shape, for example, an L-shape.

Alternatively, referring to FIGS. 4B and 4B', the extending segment 420*d*' of the external connecting portion 420 of the antenna body 42 extends around the side surface 23*c* of the encapsulant 23. As such, the extending segment 420*d*' has a bent shape, for example, a ring shape having an opening.

In the electronic module 4, 4', the external connecting portion 420 is exposed from the side surface 23*c* of the encapsulant 23 and the extending segment 420*d*, 420*d*' is attached thereto so as to increase the arrangement area of the antenna body 42 without increasing the surface area of the substrate 20. As such, the electronic module 4, 4' meets the miniaturization requirement.

Figure 5A:
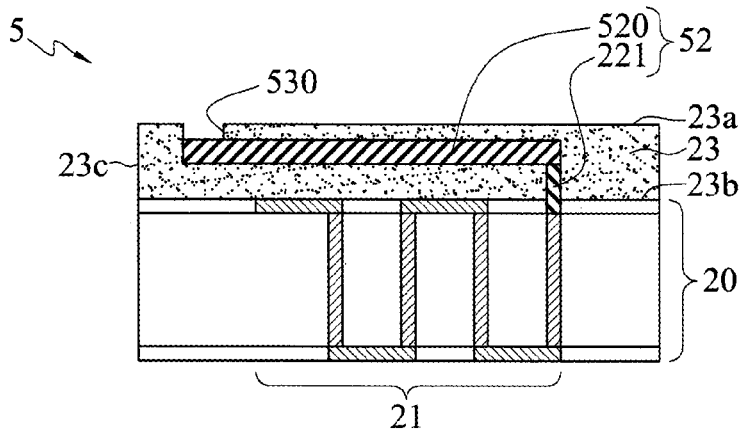
FIGS. 5A and 5B are schematic cross-sectional views of an electronic module according to a fifth embodiment of the present invention, wherein FIGS. 5A' and 5B' are schematic upper views of FIGS. 5A and 5B, respectively.
Figure 5A:
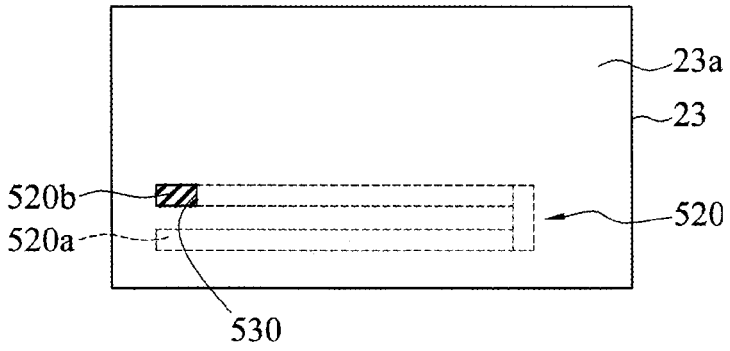
Figure 5B:
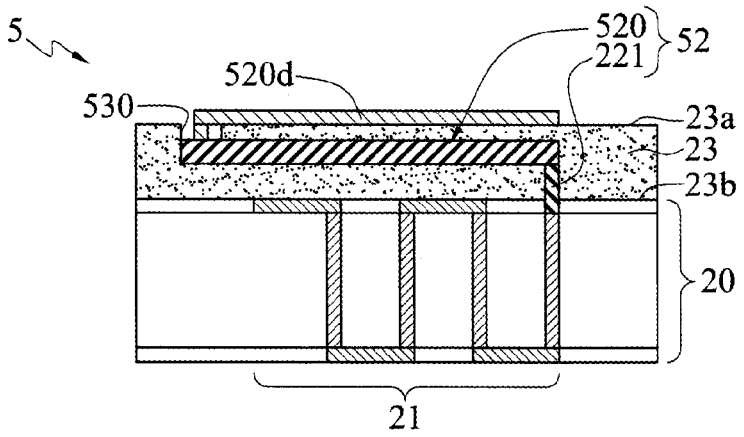
Figure 5B:
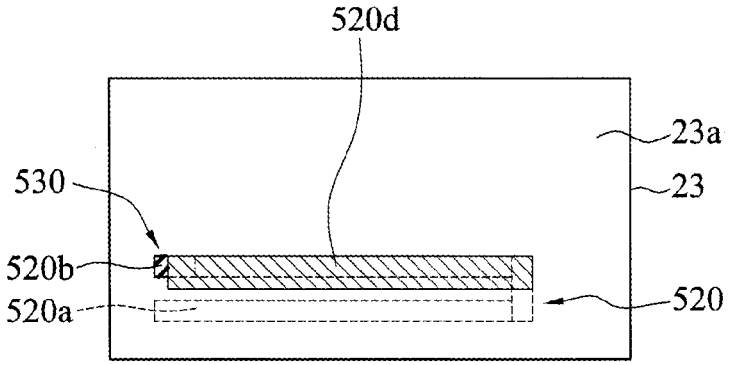

FIGS. 5A and 5B are schematic cross-sectional views of an electronic module 5, 5' according to a fifth embodiment of the present invention. The present embodiment differs from the third embodiment of FIG. 3B in the arrangement of the antenna body.

Referring to FIGS. 5A and 5A', neither the first antenna segment 520*a* nor the second antenna segment 520*b* of the external connecting portion 520 of the antenna body 52 is exposed from the side surface 23*c* of the encapsulant 23. Instead, at least an opening 530 is formed on the first surface 23*a* of the encapsulant 23 for exposing the second antenna segment 520*b*.

Further, referring to FIGS. 5B and 5B', an extending segment 520*d* can be formed by coating or plating on the exposed surface of the second antenna segment 520*b* and extend along the opening 530 to the first surface 23*a* of the encapsulant 23. As such, the extending segment 520*d* has a bent shape, for example, an L-shape.

In the electronic module 5, 5', the external connecting portion 520 is exposed from the opening 530 of the encapsulant 23 and the extending segment 520*d* is attached thereto so as to increase the arrangement area of the antenna body 52 without increasing the surface area of the substrate 20. As such, the electronic module 5, 5' meets the miniaturization requirement.

Figure 6A:
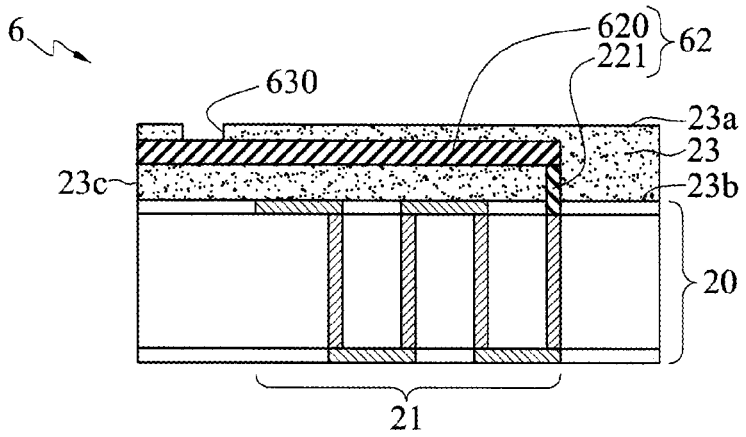
FIGS. 6A and 6B are schematic cross-sectional views of an electronic module according to a sixth embodiment of the present invention, wherein FIGS. 6A' and 6B' are schematic upper views of FIGS. 6A and 6B, respectively.
Figure 6A:
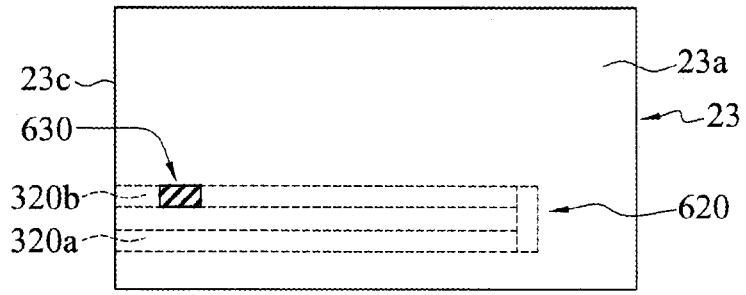
Figure 6B:
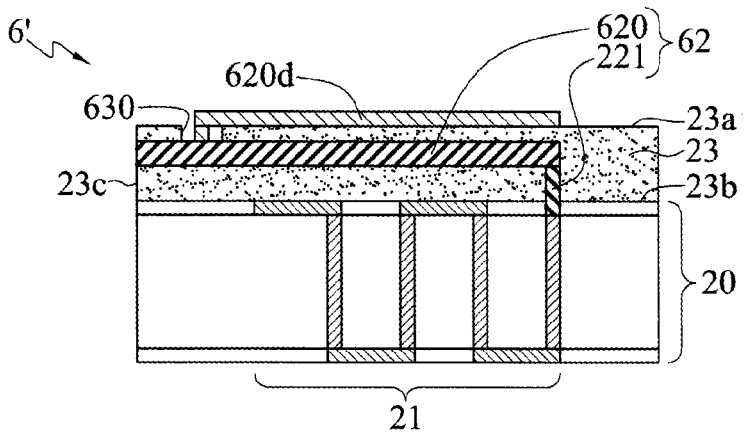
Figure 6B:
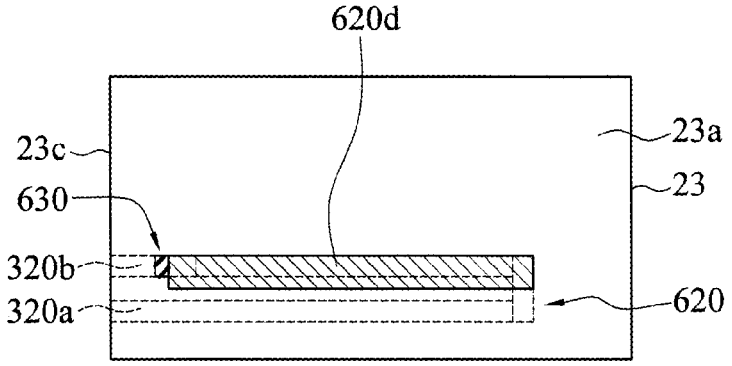

FIGS. 6A and 6B are schematic cross-sectional views of an electronic module 6, 6' according to a sixth embodiment of the present invention. The present embodiment differs from the fifth embodiment in the arrangement of the antenna body.

Referring to FIGS. 6A and 6A', the first antenna segment 320*a* and the second antenna segment 320*b* of the external connecting portion 620 of the antenna body 62 are exposed from the side surface 23*c* of the encapsulant 23. Further, at least an opening 630 is formed on the first surface 23*a* of the encapsulant 23 for exposing the second antenna segment 320*b*.

Further, referring to FIGS. 6B and 6B', a bent-shaped extending segment 620*d* can be formed on the exposed surface of the second antenna segment 320*b* by coating or plating.

In the electronic module 6, 6', the external connecting portion 620 is exposed from the opening 630 of the encapsulant 23 and the side surface 23*c* of the encapsulant 23 so as to increase the arrangement area of the antenna body 62 without increasing the surface area of the substrate 20. As such, the electronic module 6, 6' meets the miniaturization requirement.

Therefore, since the antenna body has a 3D structure and is exposed from the encapsulant, the present invention increases the arrangement area of the antenna body without increasing the size of the substrate, and also reduces the height of the encapsulant. Therefore, the electronic module of the present invention meets the miniaturization requirement.

The above-described descriptions of the detailed embodiments are only to illustrate the preferred implementation according to the present invention, and it is not to limit the scope of the present invention. Accordingly, all modifications and variations completed by those with ordinary skill in the art should fall within the scope of present invention defined by the appended claims.

What is claimed is:

1. An electronic module, comprising:

a substrate;

an antenna including first and second sections, the first section having an antenna structure that extends in a zigzag manner within the substrate, and the second section being formed over the first section and having an antenna body disposed over the substrate and having an external connecting portion; and an encapsulant formed on the substrate and encapsulating a portion of the antenna body, wherein the encapsulant has a first surface as an outward appearance of the electronic module, a second surface opposite to the first surface and bonded to the substrate, and a side surface adjacent to and connecting the first and second surfaces, wherein the external connecting portion has a bent shape surface being exposed from the first surface of the encapsulant, wherein the bent shape surface is formed with a first antenna segment, a second antenna segment, and a connecting segment connecting the first antenna segment and the second antenna segment, wherein the first antenna segment, the second antenna segment, and the connecting segment are in direct contact with the first surface of the encapsulant, and wherein the first antenna segment and the second antenna segment are not aligned with each other.

2. The module of claim 1, wherein the antenna body is exposed from the first surface of the encapsulant.

3. The module of claim 1, wherein the antenna body is exposed from the side surface of the encapsulant.

4. The module of claim 1, wherein the antenna body is exposed from the first surface and the side surface of the encapsulant.

5. The module of claim 1, wherein the antenna body has at least a supporting portion connected to the external connecting portion, the external connecting portion being supported over the substrate by the supporting portion.

6. The module of claim 5, wherein the external connecting portion is disposed on the first surface of the encapsulant and has an extending segment.

7. The module of claim 5, wherein the external connecting portion has an extending segment extending along the side surface of the encapsulant to the first surface of the encapsulant.

8. The module of claim 5, wherein the external connecting portion has an extending segment extending around the side surface of the encapsulant.

9. The module of claim 1, wherein the first surface of the encapsulant has at least an opening exposing the antenna body.

10. The module of claim 9, wherein the antenna body has an extending segment extending along the opening to the first surface of the encapsulant.

11. The module of claim 1, wherein the antenna body is electrically connected to the antenna structure.

* * * * *